US010969728B2

(12) United States Patent
Goebel et al.

(10) Patent No.: US 10,969,728 B2
(45) Date of Patent: Apr. 6, 2021

(54) CLEANING DEVICE FOR THE SURFACE OF A CYLINDER OF A PRINTER AND/OR COPIER

(71) Applicant: IDEEGO GMBH, Lichtenau (DE)

(72) Inventors: Christian Goebel, Chemnitz (DE); Peter Ueberfuhr, Chemnitz (DE)

(73) Assignee: IDEEGO GmbH, Lichtenau (DE)

( * ) Notice: Subject to any disclaimer, the term of this patent is extended or adjusted under 35 U.S.C. 154(b) by 0 days.

(21) Appl. No.: 16/340,296

(22) PCT Filed: Oct. 4, 2017

(86) PCT No.: PCT/IB2017/056105
§ 371 (c)(1),
(2) Date: Aug. 12, 2019

(87) PCT Pub. No.: WO2018/065907
PCT Pub. Date: Apr. 12, 2018

(65) Prior Publication Data

US 2019/0369547 A1 Dec. 5, 2019

(30) Foreign Application Priority Data

Oct. 7, 2016 (DE) ..... 102016119055.1

(51) Int. Cl.
*G03G 21/00* (2006.01)

(52) U.S. Cl.
CPC ... *G03G 21/0076* (2013.01); *G03G 2221/001* (2013.01); *G03G 2221/0094* (2013.01)

(58) Field of Classification Search
None
See application file for complete search history.

(56) References Cited

U.S. PATENT DOCUMENTS

| | | | |
|---|---|---|---|
| 4,835,808 | A | 6/1989 | Hahne et al. |
| 5,019,870 | A | 5/1991 | Bares |
| 5,265,537 | A | 11/1993 | Gasparrini et al. |
| 5,315,358 | A | 5/1994 | Parks et al. |
| 5,479,249 | A | 12/1995 | Jugle et al. |

(Continued)

FOREIGN PATENT DOCUMENTS

| | | | |
|---|---|---|---|
| DE | 4120973 | A1 | 1/1993 |
| DE | 10210806 | A1 | 9/2002 |

(Continued)

*Primary Examiner* — Victor Verbitsky
(74) *Attorney, Agent, or Firm* — Laurence A. Greenberg; Werner H. Stemer; Ralph E. Locher

(57) ABSTRACT

A cleaning device for a surface of a cylinder of a printer and/or a copier includes a cylindrical cleaning element which can be rotated by at least one drive and which includes a cleaning fitting on its outer periphery, and a suction or suctioner conducting at least one suction medium with at least one suction channel aligned towards the outer periphery of the cleaning element and extending along the longitudinal alignment of the cleaning element. In order to achieve a simple technical structure and a low maintenance effort apart from a good cleaning result and reliable dirt removal, a suction slit extending longitudinally of the suction channel is aligned towards the cleaning element opens into the suction channel tangentially to the suction channel cross section.

13 Claims, 1 Drawing Sheet

(56) References Cited

U.S. PATENT DOCUMENTS

| | | | | |
|---|---|---|---|---|
| 5,732,631 | A | 3/1998 | Walther et al. | |
| 6,131,011 | A * | 10/2000 | Kojima | G03G 21/1821 399/111 |
| 6,381,427 | B1 | 4/2002 | Bertram et al. | |
| 2004/0131404 | A1 | 7/2004 | Pozniakas | |
| 2012/0195659 | A1* | 8/2012 | Izawa | G03G 15/238 399/343 |

FOREIGN PATENT DOCUMENTS

| | | | |
|---|---|---|---|
| DE | 10346659 | B3 | 11/2004 |
| EP | 0245526 | A1 | 11/1987 |
| EP | 0747217 | A2 | 12/1996 |
| JP | H10034894 | A | 2/1998 |

* cited by examiner

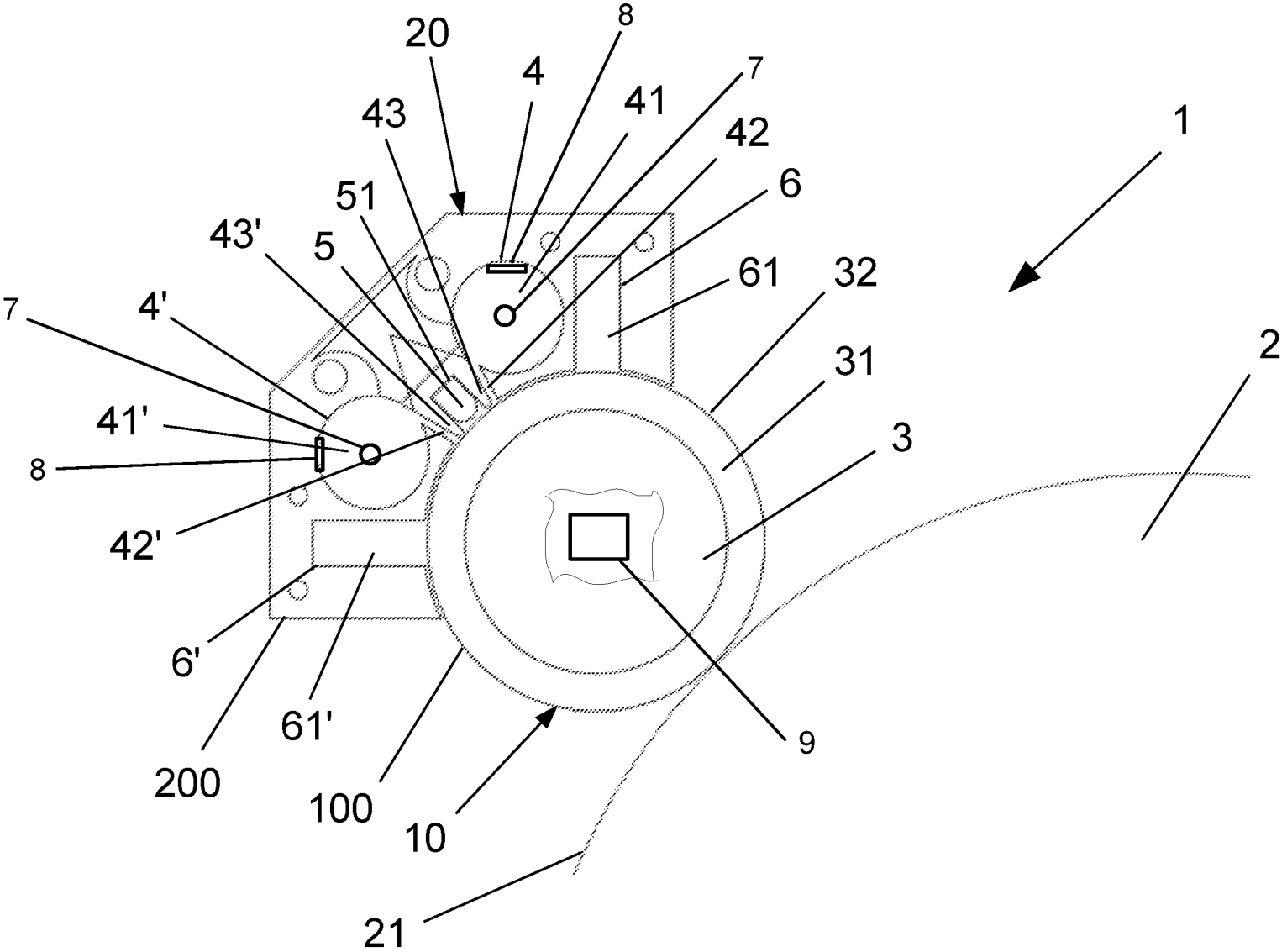
1
2
3
31
32
6
61
7
42
41
8
4
20
43
51
5
43'
4'
7
41'
8
42'
6'
200
61'
100
10
21
9

CLEANING DEVICE FOR THE SURFACE OF A CYLINDER OF A PRINTER AND/OR COPIER

BACKGROUND OF THE INVENTION

Field of the Invention

The present invention relates to a cleaning device for the surface of a cylinder of a printer and/or a copier, wherein the cleaning device comprises a cylindrical cleaning element being rotatable by means of at least one drive and comprising a cleaning fitting on its outer circumference, and a suction conducting at least one suction medium with at least one suction channel aligned towards the outer circumference of the cleaning element and extending along the longitudinal alignment of the cleaning element.

High-speed printers and copiers, which use an electrostatically preloaded transfer roller to transfer charged toner particles from the surface of an exposed and developed film or photoconductor to a material web to be printed, such as paper, are known from the prior art. Thereby, residual toner present on the film or photoconductor adheres to the transfer roller.

In order to prevent that this residual toner is transferred to the back side of the subsequent material to be printed, an elongated, cylindrical fiber or cleaning brush driven by an engine countercurrently to the transfer roller, whose longitudinal axis runs parallelly to the longitudinal axis of the transfer roller and with whose bristles toner particles and paper dust that may have accumulated are wiped off the transfer roller, is for example used in document DE 102 10 806 A1. Here, a suction system connected to a vacuum blower is provided on the fiber brush, with which particles that have been picked up by the fiber brush are sucked off. Thereby, an air flow chamber is formed around the fiber brush by means of the suction system. The air flow chamber forms an air channel, which encloses a part of the fiber brush and comprises an opening situated below the contact area between fiber brush and transfer roller and extending longitudinally of the fiber brush. The brush fibers are bent and released by means of a flicker bar provided at the end of the opening, so that particles present thereon can be dropped off the fibers, be taken up by the air current and be transported to a collection point that is arranged further away.

In order to improve the cleaning effect of the transfer roller, a variability of the distance between the axes of the fiber brush and the transfer roller as well as a high density of the fiber bristles of the cleaning brush is proposed in document DE 102 10 806 A1. The engagement, that means the distance between the transfer roller and the cleaning brush, which exceeds a position in which the bristles of the cleaning brush just touch the outer surface of the transfer roller, should furthermore be as large as possible, but not too large, in order for the transfer roller not to slip through or get blocked.

In order to improve the cleaning effect on a cylindrical surface in a printer, document DE 103 46 659 B3 proposes a cleaning device with a brush roller with a brush fitting having an oval or elliptical cross-section or with an eccentrically rotatable brush roller. In addition, the brush roller should be oscillating in axial direction. It is furthermore considered to be advantageous for the cleaning effect if the brush fitting extending over the roller width comprises bristles of differing elasticity, zonally arranged in peripheral direction. Furthermore, a cleaning fluid and/or water can be sprayed on the brush roller via spray tubes, in order to increase the cleaning effect. A squeegee furthermore engages into the brush roller.

BRIEF SUMMARY OF THE INVENTION

It is the object of the present invention to provide a cleaning device for cylinders of a printer and/or a copier, which, apart from offering a good cleaning result and a reliable dirt removal, also comprises a simple technical structure and causes low maintenance costs.

The object is solved by means of a cleaning device for a surface of a cylinder of a printer and/or a copier, wherein the cleaning device comprises a cylindrical cleaning element being rotatable by means of at least one drive and comprising a cleaning fitting on its outer circumference, and a suction conducting at least one suction medium and comprising at least one suction channel which is aligned towards the outer circumference of the cleaning element and extends along the longitudinal alignment of the cleaning element, wherein a suction slit extending longitudinally of the suction channel and being aligned towards the cleaning element opens into the suction channel tangentially to the suction channel cross section.

With the present invention, the suction is arranged on the cleaning element cleaning a cylindrical print or copy roller of the printer or copier, which is preferably arranged parallelly to the print or copy roller to be cleaned. Advantageously, the particles loosened from the print roll by means of the cleaning element as well as the cleaning media used for cleaning are sucked off continuously or intermittently by means of the suction, whereby the cleaning element as well as the print or copy roller can be kept clean and thus a high-quality print result can once again be generated.

The cleaning element which removes ink residues and other particles from the print or copy roller is preferably formed in the shape of a cylindrical brush, which extends along the entire length of the print or copy roller. The diameter of the brush can for example be within a range of 2 cm to 15 cm. The used brush usually has a brush body with a brush fitting. The brush body can be formed of wood, plastic or metal and the brush fitting can be formed of animal hair, natural fiber, plastic or chemical fibers.

In alternative embodiments of the cleaning device according to the invention, the cleaning element can also be formed of several brushes successively arranged in the longitudinal direction of the brushes. The individual brushes can have the same and/or different characteristics; the individual brushes can for example have different diameters or be made from different materials. The cleaning element can for example also present a rod-shaped body with a varying diameter. The cleaning element can furthermore also comprise cleaning cloths, nonwoven materials or the like on its circumference for cleaning the cylinder of the printer and/or the copier.

The cleaning element is rotatable by means of the drive, whereby the print or copy roller can be particularly thoroughly cleaned.

The cleaning process of the cylinder of the printer or copier, for example of the print or copy roller, can take place during, after and/or immediately prior to the beginning of a printing or copying process.

The suction is preferably arranged within close proximity to the cleaning element, so that the particles of ink or dirt as well as a cleaning medium that may additionally be used for cleaning the print roller can easily be sucked off, leaving virtually no residues. To this end, the suction in the present invention comprises a suction slit extending along the suction channel and opening into the suction channel. This suction slit is aligned tangentially to the suction channel cross section towards the cleaning element. The impurities and/or cleaning media sucked-in from the surface of the cleaning element by means of the suction via the suction slit are conveyed into the suction channel and thence to a disposal and/or processing device. The suction channel is coupled to a suction system for sucking-in dirt, which among others includes contaminated cleaning fluid, air, ink, particles, emulsions or the like. For this purpose, a corresponding suction tract adjoins the suction channel. The sucked-in dirt thus first passes through the suction slit, then into the suction channel and from there into the suction tract.

According to the invention, a first end of the suction slit is thus aligned towards the cleaning element, whereas a second end of the suction slit opens into the suction channel tangentially to a suction channel cross section.

It has hereby proven to be particularly advantageous if the suction channel is formed tube-shaped, is arranged parallelly next to the brush-like formed cleaning element or to the print or copy roller, and extends over the entire length of the cleaning element or the print roller. In such an embodiment of the suction channel, the suction slit preferably extends over the entire length of the suction channel and is aligned towards the cleaning element or the print roller, so that contaminations and/or cleaning media can be particularly thoroughly sucked off the cleaning element or the print roller.

Such an embodiment of suction channel and suction slit leads to a particularly advantageous eddy current formation inside the suction channel, whereby particles of dirt, cleaning media and the like can be particularly well sucked off the cleaning element and/or the print roller.

In other embodiments of the cleaning device according to the invention, several, successively arranged suction slits can also be provided on the suction channel. The suction channel furthermore does not need to be formed tube-shaped, but can for example also be formed with an angular internal cross section.

With the cleaning device according to the invention, a particularly good cleaning result of the cylinder of the printer and/or the copier can be achieved. Due to the dirt suction of the cleaning element according to the invention, its maintenance intervals are furthermore increased and its maintenance costs are minimized at the same time. This is also reflected in the maintenance costs for the print and/or copy cylinder. By suctioning-off contaminations, the individual components of the cleaning device according to the invention are protected, whereby a smaller demand for spare parts is necessary.

In an embodiment of the cleaning device according to the invention, the suction channel has an internal cross section that increases outwardly on both sides in its longitudinal alignment. The increase of the internal cross section towards a first and a second end of the suction channel results in an additional suction effect, whereby the cleaning element is particularly advantageously sucked off and the cylinder of the printer and/or the copier can be particularly thoroughly cleaned.

With a tube-shaped embodiment of the suction channel, it has proven to be advantageous if the tube increases conically towards the first and the second end of the tube. The tube diameter can generally also be gradually reduced towards the first and the second end of the tube. A gradual outward increase of the inner cross section of the suction channel is also useful if the suction channel does not present a round, but an angular inner cross section.

It has furthermore proven to be useful if at least one of the bars forming the suction slit projecting longitudinally of the suction channel is formed of flexible material. Such a flexible embodiment of the suction slit enables an easy cleaning of the suction slit in case of a blockage, for example due to very large sucked-in particles, and at the same time prevents a very fast blocking of the suction slit by larger particles. Due to their flexible embodiment, the bars can for example be flipped aside in case of contamination, and the contamination, such as particles or the like, can be removed from the suction slit.

With a special embodiment of the suction slit, the bars of the suction slit are preferably formed as separate elements and are connected to the suction channel. The bars of the suction slit can for example be made of caoutchouc, rubber or flexible plastic membranes.

If there is a rod or an inner tube running centrally through the suction channel and that the suction medium does not flow through, the suction medium sucked-in by the suction slit can be particularly well conducted through the suction channel towards a disposal and processing device of the cleaning device due to an advantageous formation of eddy currents around the rod or the inner tube. The diameter of the rod or the inner tube can for example range from 1 cm to 10 cm.

Depending on the embodiment of the cleaning device according to the invention, the rod or the inner tube can be permanently inserted in the suction channel or it can be mounted insertable and removable again in the suction channel. The rod or the inner tube can for example be made of plastic or metal. The rod or the inner tube can be formed straight, with a smooth surface, or coiled in a thread-like way.

For a particularly advantageous conduction of the medium sucked-in by the suction slit through the suction channel towards a disposal and processing device of the cleaning device according to the invention, it has furthermore proven to be advantageous if at least one flow directing plate is provided in the suction channel next to a suction area of the suction channel adjoining a suction tract. The flow directing plate can for example be provided between an inner wall of the suction channel and a rod or an inner tube provided inside the suction channel, so that the sucked-in medium can flow around the rod or the inner tube in only one direction, whereby a particularly advantageous eddy current forms inside the suction channel.

The flow directing plate can be made of the same material as the suction channel or of a material differing from the material of the suction channel. The flow directing plate can furthermore be integrally formed with the suction channel or be attached to the suction channel permanently or temporarily.

For a particularly efficient suction of the cleaning element and a respective effective cleaning of the cylinder of the printer and/or the copier, at least one squeegee, which is aligned towards the cleaning element and around which the suction medium can flow, is provided next to the suction channel and longitudinally of the suction channel.

The squeegee serves for wiping the surface of the cleaning element, wherein the cleaning element is typically moved relatively to the squeegee and the squeegee loosens particles and liquids adhering to the cleaning element, such as ink residues, detergents, water and other fluidic media used in the printing or copying process, which are subsequently sucked-off by means of the suction.

In a special embodiment of the cleaning device according to the invention, the squeegee is formed rod-shaped, but can also be formed plate-, strap- or block-shaped in alternative variants.

Depending on the texture of the cleaning element, the squeegee can be made of caoutchouc, metal or plastic. Only one squeegee or several squeegees can be provided along the cleaning element.

It has proven to be particularly advantageous, if the squeegee is provided inside a guide and is formed positionally adjustable relative to the cleaning element.

The guide hereby advantageously extends parallelly to the entire length of the cleaning element, so that all areas of the cleaning element can be reached and cleaned. Such an attachment of the squeegee on the cleaning device has proven itself, especially with regard to a brush-shaped formation of the cleaning element, since the entire cleaning element can thus be effectively cleaned.

The squeegee can be aligned vertically to a peripheral surface of the cleaning element or set aligned at an angle to the peripheral surface of the cleaning element. The angle, in which the squeegee is aligned towards the cleaning element, can advantageously also be varied.

For an easy replacement or an easy cleaning and maintenance of the squeegee, it has proven to be particularly advantageous if the squeegee is mounted removable and insertable again in the guide. However, the squeegee can also be permanently mounted in the guide.

It is furthermore advantageous if the squeegee is linearly adjustable radially or in an angular position to the rotation axis of the cleaning element.

A placement or removal of the squeegee towards the cleaning element for example allows for the squeegee also to be used when using differently formed cleaning elements such as brushes with different diameters or a differing cleaning fitting. Depending on the attrition of the cleaning element or its cleaning fitting and/or due to procedural reasons, the squeegee can furthermore also be positioned or changed in position during the cleaning process in radial direction of the cleaning element.

In a particularly preferable embodiment of the cleaning device according to the invention, a suction channel each is provided on both sides of the squeegee. By applying two suction channels, the suction capacity of the cleaning device and thus the cleaning result can be improved. By applying the second suction channel, there is furthermore also a second suction direction for the suction medium to be sucked off, whereby particles or the like can potentially be sucked in, which would not be seized by the suction effect of the first suction channel.

The second suction channel is advantageously formed mirror-symmetrical to the first suction channel, but can also present a different form and/or dimensions than the first suction channel in certain embodiments of the cleaning device according to the invention. Particularly preferably, a suction slit aligned towards the cleaning element also extends along the second suction channel as well as along the first suction channel and opens into the second suction channel tangentially to the suction channel cross section.

The sucked-in medium flowing in the second suction channel is advantageously forwarded to the same disposal and/or processing device, with which the first suction channel is also coupled.

The drive for the cleaning element is preferably provided on a longitudinal end of the brush. Alternatively, the cleaning element can, however, also be rotated by means of two drives provided on both sides of the brush or by means of a coupling of the brush with the drive of the print roller. For a particularly thorough cleaning, the cleaning element preferably rotates in opposite direction of the cylinder to be cleaned, but can also rotate in the same direction as the print roller.

Especially with a tube-shaped embodiment of the cleaning element, it has proven to be particularly advantageous if the at least one drive is provided within the cleaning element and is fixed on a machine wall of the printer and/or the copier, since the drive can thus be provided particularly space-saving.

Conveniently, two drives for the cleaning element, which are fixed on opposite machine walls of the printer and/or the copier, can also be provided in the cleaning element. Such an embodiment enables a particularly efficient drive of the cleaning element. Since the inner diameter of the cleaning element has a limited extent only, engines with a smaller diameter and thus a lower capacity can also be used as a drive in this embodiment of the invention, since due to the two engines, the engine power is doubled in comparison to only one engine.

For an effective cleaning it has furthermore proven to be advantageous, if the cleaning device comprises a humidifier with at least one spray bar extending longitudinally of the suction channel. Due to the spray bar, a cleaning medium can be applied to the cleaning element and/or the cylinder of the printer and/or the copier, which supports the cleaning process. By spraying-on the cleaning medium, ink residues that are dried-in or difficult to access, can be removed more easily. Spraying-on the cleaning medium furthermore chemically/physically supports the cleaning of the cylinder(s) of the printer and/or the copier, such as the chemical/physical dissolving of ink residues and/or the emulsifying of particles and other solid residues of the printing or copying process present on the surface of the cleaning element and/or the cylinder.

Thereby, several individual spray nozzles or one spray nozzle extending across the entire or nearly the entire length of the spray bar can be provided in the spray bar. For an optimal cleaning, the spray bar is aligned towards the cleaning element and/or towards the cylinder of the printer and/or the copier to be cleaned. The spray nozzles can be used permanently during the entire cleaning process, intermittently or only at the beginning and/or once during the cleaning process.

In a favored embodiment of the cleaning device according to the invention, two spray bars are provided on both sides of the suction channel, wherein both spray bars can be formed alike or different.

It has proven to be particularly advantageous, if the humidifier comprises at least one first spray bar for spraying the cleaning element with water and at least one second spray bar for spraying the cleaning element with a detergent, wherein the first and the second spray bar are arranged on opposite walls of the suction channel.

Due to the separate use of water and detergent, a mixing of the water and the detergent prior to their use can be dispensed with. Nonetheless, it can be made sure that the desired ratio of water to detergent is always used during the entire usage of the humidifier and that the mixing ratio does not change, for example due to a segregation of a water-detergent-mixture mixed before usage. The ratio of usage of water and detergent can furthermore also be easily precisely controlled during the cleaning process. There is also the possibility to temporarily only use water for cleaning or to increase or to lower the supply of detergent, for example depending on a previously determined degree of contamination of the cleaning element and/or the cylinder of the copier and/or the printer to be cleaned. Naturally, the ratio of water to detergent can, however, also remain consistent during the entire cleaning cycle. It is also possible that not only water and detergent emerge from the spray bar, but that a water-detergent-mix or water and detergent are alternately dispensed. The spray bar can also dispense an aerosol mixture of water and air or detergent and air or a combination thereof.

Insofar as the cleaning device according to the invention comprises two suction channels, it has proven to be advantageous, if one spray bar each is provided next to a suction channel, so that both spray bars enclose the centrally arranged suction channels, aligned parallelly to each other. With such an embodiment of the cleaning device according to the invention, the guide for the squeegee is advantageously provided parallelly to the two suction channels, between the two suction channels.

Two spray bars each arranged on both sides of a suction channel can furthermore also be provided in other embodiments of the device according to the invention.

In a particularly advantageous embodiment of the cleaning device according to the invention, the cleaning device has a first module, which comprises the cleaning element and its drive components, and a second module, which comprises the suction, its components and the humidifier, wherein the second module can be demounted from the printer and/or the copier without having to demount a component of the first module from the printer and/or the copier.

Due to the possibility of a separate removal of the second module from the printer and/or the copier, the suction as well as the humidifier can on the one hand be easily cleaned, maintained, repaired and exchanged. Furthermore, the accessibility to the cleaning element and its drive components is also improved, whereby these components are also easier to clean, to maintain, to repair and/or to exchange.

In a preferred embodiment of the cleaning device according to the invention, the first module can also be easily and smoothly demounted from the copier and/or the printer.

It is particularly practical if the components of the second module are provided in a shared housing, separately demountable from the components of the first module of the printer and/or the copier. The housing not only protects the individual components against contamination, but also allows for all components of the first module to be removed from the copier and/or printer at the same time, whereby the removal and installation of the first module is simplified.

The components of the second module can furthermore also be encased by a housing. There, it is also possible that the first and the second module are encased by a shared housing provided in addition to the housings of the first and second module or replacing the housings of the first and second module.

It is particularly advantageous, if the second module is placed or placeable in a rucksack-like way on the first module. Hereby, at least the part of the second module aligned towards the first module is adjusted to fit the shape of the first module. Insofar as the cleaning element of the first module is formed cylindrically, the first module presents an overall cylindrical form, whereby the second module can advantageously have a curved, semi-tubular embodiment, in order to be placed on the first module in a rucksack-like way. Such an embodiment of the second module makes it possible for the components of the second module to interact particularly efficiently with the components of the first module and that a cleaning of the cleaning element or the cylinder of the copier and/or the printer to be cleaned is particularly thorough.

BRIEF DESCRIPTION OF THE SEVERAL VIEWS OF THE DRAWING

A preferred embodiment of the present invention, its structure, function and advantages are explained in more detail below with reference to FIG. 1, wherein FIG. 1 schematically shows an embodiment of the cleaning device according to the invention in a cut side view.

DESCRIPTION OF THE INVENTION

FIG. 1 schematically depicts a preferred embodiment of a cleaning device 1 according to the invention for cleaning a surface 21 of a cylinder 2 of a printer and/or a copier not shown in more detail. In the present example, the cylinder 2 is the print cylinder of a printer.

The cleaning device 1 comprises a first module 10 and a second module 20, wherein the second module 20 is placed on the first module 10 in a rucksack-like way. Both modules 10, 20 are attached at the printer. Hereby, the second module 20 can be taken-off from the printer without having to demount the first module 10.

In the shown embodiment, the first module 10 comprises a brush-like formed cleaning element 3, which comprises a cleaning fitting 31 in the form of bristles on its outer circumference. The cleaning element 3 is rotatably driven by a drive 9 provided in the cleaning element 3 and fixed on a machine wall or two drives 9 provided in the cleaning element 3 and fixed on opposite machine walls of the printer or copier, that is not depicted, and guided across the surface 21 of the cylinder 2 for cleaning the surface 21 of a cylinder 2 of the printer. For a particularly efficient cleaning of the cylinder 2, the cleaning element 3 moves in the opposite direction of the cylinder 2. In other embodiments of the cleaning device 1 according to the invention, the cleaning element 3 can, however, also be moved in the same direction as the cylinder 2 to be cleaned, or it can stand still compared to the moving cylinder 2.

As can be seen in FIG. 1, the cleaning element 3 is formed cylindrically and is aligned parallelly to the cylinder 2, wherein the cleaning element 3 extends across the entire length of the cylinder 2, so that the entire cylinder circumference of the cylinder 2 can be cleaned of dirt by the cleaning element 3.

The cleaning element 3 can be formed of one or several brush(es) and/or comprise one or several cleaning cloths or wipes on its cylinder circumference. If several brushes are used as cleaning elements 3, the brushes can either be successively arranged in the longitudinal direction of the printing cylinder, or several brushes are provided in the cylinder circumferential direction of the cylinder 2. The cleaning element 3 can generally also be formed rod-like with a varying diameter. However, it is particularly advantageous if the cleaning element 3 is adjusted to the outer form of the cylinder 2 to be cleaned, so that it can be particularly thoroughly cleaned.

In the shown embodiment, the drive driving the cleaning element 3 protrudes into the tube-shaped cleaning element 3 and is on the other hand fixed on a machine wall of the printer, whereby the cleaning device 1 can be formed particularly compactly. In other embodiments of the cleaning device 1 according to the invention, two drives can also be attached or included on both ends of the cleaning element 3. The at least one drive can furthermore also be placed separately from the cleaning element 3 on the cleaning device 1.

The cleaning of the cylinder 2 can take place directly during a printing process, so that the cylinder 2, such as a counterpressure cylinder, is continuously cleaned and a particularly high-quality print result can be generated. In alternative embodiments of the cleaning device 1 according to the invention, in which the cylinder 2 to be cleaned is for example a blanket cylinder, the cleaning of the cylinder 2 can also take place after finishing the printing process and/or before the beginning of the printing process and/or at intervals during the printing process.

The cleaning element 3 is cleaned by means of the components of the second module 20 of the cleaning device 1, so that a transmission of dirt from the cleaning element 3 to the cylinder 2 during the cleaning process of the cylinder 2 is impossible. For this purpose, the second module 20 attached to the first module 10 in a rucksack-like way comprises two suctions 4, 4', a squeegee 5 as well as two humidifiers 6, 6'.

As shown in FIG. 1, the second module 20, in particular the half of the second module 20 aligned towards the first module 10, is adjusted to the form of the first module 10, in particular to the form of the cleaning element 3.

The suctions 4, 4' each comprise a suction channel 41, 41', in which dirt particles, fluids and the like located on the cleaning brush 3, are sucked-away through a suction slit 42, 42'. For a particularly efficient suction, the suction channels 41, 41' are formed tube-shaped tapering from both ends of the tube to its centre, wherein they extend across the entire length of the brush in the longitudinal direction of the brush. The suction slits 42, 42' extend over the entire length of the respective suction channel 41, 41', wherein the suction slits 42, 42' are provided in such a way that they are aligned towards the cleaning brush 3 and open into the suction channel 41, 41' tangentially to the suction channel cross-section.

In the shown embodiment, the suction slits 42, 42' are formed by bars 43, 43' projecting the respective suction channel 41, 41', which run longitudinally of the suction channel 41, 41'. In the specific embodiment, the bars 43, 43' are formed of a flexible material, so that a blockage of the suction slits 42, 42' is prevented or can be more easily fixed. The remaining components of the cleaning device 1 on the other hand, are formed of a stable, largely inflexible material, such as plastic or metal, but can also be made of other materials in other variants.

The suction medium sucked into the suction channels 41, 41' is transported away to a shared disposal and/or processing device through tubes (not shown) attached to the suction channels 41, 41'.

To initiate the suction of the suction medium, the suction channels 41, 41' are connected to a suction system that is not depicted here. Hereby, a suction takes place through both suction channels 41, 41' at the same time. The respective suction medium can just as well be sucked away independently from one another via the suction channels 41, 41'.

With the cleaning device 1 according the invention, several suctions 4, 4' or one suction 4, 4' only can be provided on the first module 10 of the cleaning device 1. The suction channels 41, 41' can have a round or an angular inner cross section. Just like in the shown embodiment, the suction slit 42, 42' can extend over the entire length of the suction channel 41, 41' or can be assembled of several suction slits 42, 42', which are successively arranged in the longitudinal direction of the suction channel.

For a better formation of the eddy current and thus an improved media guidance, a rod or an inner tube 7 that the suction medium does not flow through, can also be provided centrally in the tube-shaped suction channels 41, 41' in other embodiments of the cleaning device 1 according to the invention. For optimizing the media guidance, at least one flow directing plate 8 can furthermore be provided within the respective suction channel 41, 41'.

For cleaning the cleaning element 3, in the shown embodiment the squeegee 5, which is led in a guide 51 running along parallelly to the longitudinal extension of the cleaning element 3, is provided between the two suctions 4, 4' and removes in particular persistently adhering contaminations from the cleaning element 3, which are subsequently sucked away by the suctions 4, 4'.

In the shown embodiment, the squeegee 5 is formed rod-like and it is movable in the guide 51. A setting angle, with which the squeegee 5 is aligned relatively to the cleaning element 3, is furthermore also variable. For a particularly efficient cleaning of the cleaning element 3, in particular the position of the squeegee 5 towards the cleaning element 3 can be changed, so that the squeegee 5 can dip deeper or less deep into the cleaning fitting of the cleaning element 3. Due to the movement of the squeegee 5 towards the cleaning element 3, a possible attrition of the cleaning element 3 during the cleaning process of the cylinder 2 can furthermore be compensated and the cylinder 2 can thus be cleaned with a constant cleaning quality.

In alternative embodiments of the cleaning device 1 according to the invention, several squeegees 5 can also be included in the guide 51. Several guides 51 can furthermore also be provided on the second module 20, which comprise at least one or several squeegees 5. In an alternative embodiment of the cleaning device 1 according to the invention, the squeegee 5 can also be formed for example plate-, strap- or block-shaped.

Apart from the suctions 4, 4' in the outer areas of the first module 10, a humidifier 6, 6' each is arranged, each of which has a spray bar 61, 61'. The spray bars 61, 61' are aligned in longitudinal direction of the cleaning element 3 and extend across the entire length of the cleaning element 3.

In the shown embodiment, the spray bar 61 applies water to the cleaning element 3, whereas the spray bar 61' applies a detergent to the cleaning element 3. By adding water and detergent to the cleaning element 3, even dried-in contaminations that are difficult to remove can be loosened from the cleaning element 3 by means of the squeegee 5 and the suctions 4, 4'.

The application of water and detergent to the cleaning element 3 preferably takes place continuously during the entire cleaning process, but can also be initiated intermittently, only at the beginning and/or at intervals during the cleaning process or due to a previously determined degree of contamination of the cleaning element 3.

Detergent-water-mixtures can also be sprayed onto the cleaning element 3 by means of the spray bars 61, 61'. For this purpose, the detergent and the water can have been mixed prior to injection, or the detergent and the water are sprayed out of a spray bar 61, 61' one after the other or at the same time, but separately from each other, through individual spray nozzles provided in the spray bars 61, 61'.

In alternative variants, the cleaning device 1 can also comprise more or less than two humidifiers 6, 6'. The humidifiers 6, 6' also do not need to comprise a spray bar 61, 61'; instead the humidifiers 6, 6' can also comprise individual spray nozzles, which are arranged spread-out in the first module 10 of the cleaning device 1 and are aligned towards the cleaning element 3.

Both the first and the second module 10, 20 are enclosed by a housing 100, 200 for an easier installation and removal, which at the same time protects the components of the first and second module 10, 20 from contamination by ink, detergent or the like. Both modules 10, 20 can additionally be enclosed by a shared housing, so that the entire cleaning device 1 can be removed from the printer or can be arranged on it at once.

The invention claimed is:

1. A cleaning device for a surface of a cylinder of at least one of a printer or a copier, the cleaning device comprising:

a rotatably driven cylindrical cleaning element having a rotation axis, a longitudinal alignment, an outer periphery and a cleaning fitting on said outer periphery;

a suctioner conducting at least one suction medium;

said suctioner including at least one suction channel aligned towards said outer periphery of said cleaning element, extending along said longitudinal alignment of said cleaning element and having a suction channel cross section;

into said at least one suction channel tangentially to said suction channel cross section; and a humidifier having at least one spray bar extending longitudinally of said at least one suction channel, said at least one spray bar of said humidifier including at least one first spray bar for spraying said cleaning element with water and at least one second spray bar for spraying said cleaning element with detergent, said first and second spray bars being disposed on opposing sides of said at least one suction channel.

2. The cleaning device according to claim 1, wherein said at least one suction channel has a longitudinal alignment and an inner cross section outwardly increasing on both sides in said longitudinal alignment.

3. The cleaning device according to claim 1, wherein said at least one suction slit is formed by bars and at least one of said bars projects longitudinally from said at least one suction channel and is formed of flexible material.

4. The cleaning device according to claim 1, which further comprises a rod or an inner tube running through said at least one suction channel and not conducting the suction medium.

5. The cleaning device according to claim 1, which further comprises at least one flow directing plate provided in said at least one suction channel next to a suction area of said at least one suction channel adjoining a suction tract.

6. The cleaning device according to claim 1, wherein said at least one squeegee is rod-shaped.

7. The cleaning device according to claim 1, wherein said at least one suction channel includes two suction channels each being provided on a respective side of said at least one squeegee.

8. The cleaning device according to claim 1, which further comprises at least one drive provided within said cleaning element and fixed on a machine wall of at least one of the printer or the copier.

9. The cleaning device according to claim 8, wherein said at least one drive for said cleaning element includes two drives provided in said cleaning element and fixed on opposing machine walls of at least one of the printer or the copier.

10. A cleaning device for a surface of a cylinder of at least one of a printer and a copier, the cleaning device comprising:

a rotatably driven cylindrical cleaning element having a longitudinal alignment, an outer periphery and a cleaning fitting on said outer periphery;

a suctioner conducting at least one suction medium;

said suctioner including at least one suction channel aligned towards said outer periphery of said cleaning element, extending along said longitudinal alignment of said cleaning element and having a suction channel cross section;

said suctioner including at least one suction slit extending longitudinally of said at least one suction channel, being aligned towards said cleaning element and opening into said at least one suction channel tangentially to said suction channel cross section; and a humidifier having at least one spray bar extending longitudinally of said at least one suction channel, said at least one spray bar of said humidifier including at least one first spray bar for spraying said cleaning element with water and at least one second spray bar for spraying said cleaning element with detergent, said first and second spray bars being disposed on opposing sides of said at least one suction channel.

11. A cleaning device for a surface of a cylinder of at least one of a printer or a copier, the cleaning device comprising:

a rotatably driven cylindrical cleaning element having a longitudinal alignment, an outer periphery and a cleaning fitting on said outer periphery;

a suctioner conducting at least one suction medium;

said suctioner including at least one suction channel aligned towards said outer periphery of said cleaning element, extending along said longitudinal alignment of said cleaning element and having a suction channel cross section;

said suctioner including at least one suction slit extending longitudinally of said at least one suction channel, being aligned towards said cleaning element and opening into said at least one suction channel tangentially to said suction channel cross section;

a humidifier having at least one spray bar extending longitudinally of said at least one suction channel;

a first module including said cleaning element and drive components; and a second module including said suctioner, components of said suctioner and said humidifier;

said second module being demountable from at least one of the printer or the copier without having to demount a component of said first module from at least one of the printer or the copier.

12. The cleaning device according to claim 11, which further comprises a housing shared by components of said second module being separately demountable from components of said first module.

13. The cleaning device according to claim 11, wherein said second module is placed or configured to be placed on said first module in a rucksack-like way.

* * * * *